US010341766B1

(12) United States Patent
Dyrholm

(10) Patent No.: US 10,341,766 B1
(45) Date of Patent: Jul. 2, 2019

(54) MICROPHONE APPARATUS AND HEADSET

(71) Applicant: GN Audio A/S, Ballerup (DK)

(72) Inventor: Mads Dyrholm, Ballerup (DK)

(73) Assignee: GN Audio A/S (DK)

( * ) Notice: Subject to any disclaimer, the term of this patent is extended or adjusted under 35 U.S.C. 154(b) by 0 days.

(21) Appl. No.: 16/202,313

(22) Filed: Nov. 28, 2018

(30) Foreign Application Priority Data

Dec. 30, 2017 (DK) ..... 2017 00754

(51) Int. Cl.
*H04R 3/00* (2006.01)
*H04R 1/40* (2006.01)
(Continued)

(52) U.S. Cl.
CPC ..... *H04R 3/005* (2013.01); *G10L 25/78* (2013.01); *H04R 1/406* (2013.01); *H04R 3/04* (2013.01); *H04R 29/005* (2013.01)

(58) Field of Classification Search
CPC . H04R 3/00; H04R 3/005; H04R 3/04; H04R 1/406; H04R 5/00; H04R 5/04;
(Continued)

(56) References Cited

U.S. PATENT DOCUMENTS 8,068,619 B2 * 11/2011 Zhang ..... G10L 15/04 381/110
2009/0304203 A1 * 12/2009 Haykin ..... G10L 21/02 381/94.1
(Continued)

FOREIGN PATENT DOCUMENTS

EP 2819429 12/2014
EP 2884763 6/2015
(Continued)

OTHER PUBLICATIONS

Danish Search Report / Opinion from the Danish Patent Office dated Aug. 30, 2018 for Danish patent application No. PA 201700754.

*Primary Examiner* — Thang V Tran
(74) *Attorney, Agent, or Firm* — Altera Law Group, LLC

(57) ABSTRACT

The present invention relates to a microphone apparatus (10) with a main beamformer (F, BF) that provides a directional audio output ($S_F$) by combining microphone signals (X, Y) from multiple microphones (11, 12).
The quality of beamformed microphone signals normally depends on the individual microphones having equal sensitivity characteristics across the used frequency range. The invention enables automatic adaptation of the main beamformer (F, BF) to variations in microphone sensitivity and to changes in the alignment of the microphone apparatus (10) with respect to the user's mouth (7).
This is achieved by having the microphone apparatus (10): estimate a suppression filter (Z) for an optimum voice-suppression beamformer (Z, BZ) based on the microphone signals (X, Y); estimate a candidate filter (W) for a candidate beamformer (W, BW) as the complex conjugate of the suppression filter (Z); estimate the performance of the candidate beamformer (W, BW); and replace a main filter (F) in the main beamformer (F, BF) with the candidate filter (W) if the candidate beamformer (W, BW) is estimated to perform better than the current main beamformer (F, BF).
The invention may be used to enhance speech quality and intelligibility in headsets 1 and other audio devices that pick up user voice.

10 Claims, 4 Drawing Sheets

(51) Int. Cl.
*G10L 25/78* (2013.01)
*H04R 29/00* (2006.01)
*H04R 3/04* (2006.01)

(58) Field of Classification Search
CPC ..... H04R 29/00; H04R 29/005; G10L 25/78; G10L 21/0208; G10L 2021/02166; G10L 2021/02165
See application file for complete search history.

(56) References Cited

U.S. PATENT DOCUMENTS

| | | | | |
|---|---|---|---|---|
| 2010/0061568 | A1* | 3/2010 | Rasmussen | H04R 3/005 381/94.1 |
| 2015/0172807 | A1* | 6/2015 | Olsson | G10K 11/175 381/74 |
| 2015/0294674 | A1 | 10/2015 | Takahashi | |
| 2017/0164102 | A1* | 6/2017 | Ivanov | H04R 1/406 |

FOREIGN PATENT DOCUMENTS

| | | |
|---|---|---|
| EP | 2999235 | 3/2016 |
| WO | WO2009/034524 | 3/2009 |

* cited by examiner

MICROPHONE APPARATUS AND HEADSET

TECHNICAL FIELD

The present invention relates to a microphone apparatus and more specifically to a microphone apparatus with a beamformer that provides a directional audio output by combining microphone signals from multiple microphones. The present invention also relates to a headset with such a microphone apparatus. The invention may e.g. be used to enhance speech quality and intelligibility in headsets and other audio devices.

BACKGROUND ART

In the prior art, it is known to filter and combine signals from two or more spatially separated microphones to obtain a directional microphone signal. This form of signal processing is generally known as beamforming. The quality of beamformed microphone signals depends on the individual microphones having equal sensitivity characteristics across the relevant frequency range, which, however, is challenged by finite production tolerances and variations in aging of components. The prior art therefore comprises various techniques directed to calibrate microphones or otherwise handle deviating microphone characteristics in beamformers.

European patent application EP 2884763 A1 discloses a headset with a microphone apparatus adapted to provide an output audio signal (O) in dependence on voice sound received from a user of the microphone apparatus, where the microphone apparatus comprises a first microphone unit (M1) adapted to provide a first input audio signal in dependence on sound received at a first sound inlet and a second microphone unit (M2) adapted to provide a second input audio signal in dependence on sound received at a second sound inlet spatially separated from the first sound inlet (see FIG. 1 and paragraphs [0058]-[0065]). The microphone apparatus further comprises a linear main filter with a main transfer function adapted to provide a main filtered audio signal in dependence on the second input audio signal, a linear main mixer ($BF1_L$) adapted to provide an output audio signal ($X_L$) as a beamformed signal in dependence on the first input audio signal and the main filtered audio signal, and a main filter controller adapted to control the main transfer function to increase the relative amount of voice sound in the output audio signal (O) (see FIG. 1 and paragraphs [0066]-[0069]). It further suggests " . . . using microphones with very small variations in sensitivities . . . " or " . . . microphone sensitivities may be estimated in a calibration step at the time of production." to ensure equal sensitivity characteristics. Both of these measures would normally increase production costs.

Also, adaptive alignment of the beam of a beamformer to varying locations of a target sound source is known in the art. There is, however, still a need for improvement.

DISCLOSURE OF INVENTION

It is an object of the present invention to provide an improved microphone apparatus without some disadvantages of prior art apparatuses. It is a further object of the present invention to provide an improved headset without some disadvantages of prior art headsets.

These and other objects of the invention are achieved by the invention defined in the independent claims and further explained in the following description. Further objects of the invention are achieved by embodiments defined in the dependent claims and in the detailed description of the invention.

Within this document, the singular forms "a", "an", and "the" are intended to include the plural forms as well (i.e. to have the meaning "at least one"), unless expressly stated otherwise. Correspondingly, the words "has", "includes" and "comprises" are meant to specify the presence of respective features, operations, elements and/or components, but not to preclude the presence or addition of further entities. The term "and/or" generally shall include any and all combinations of one or more of the associated items. The steps or operations of any method disclosed herein need not be performed in the exact order disclosed, unless expressly stated so.

BRIEF DESCRIPTION OF THE DRAWINGS

The invention will be explained in more detail below together with preferred embodiments and with reference to the drawings in which.

The figures are schematic and simplified for clarity, and they just show details essential to understanding the invention, while other details may be left out. Where practical, like reference numerals and/or names are used for identical or corresponding parts.

MODE(S) FOR CARRYING OUT THE INVENTION

Figure 1:
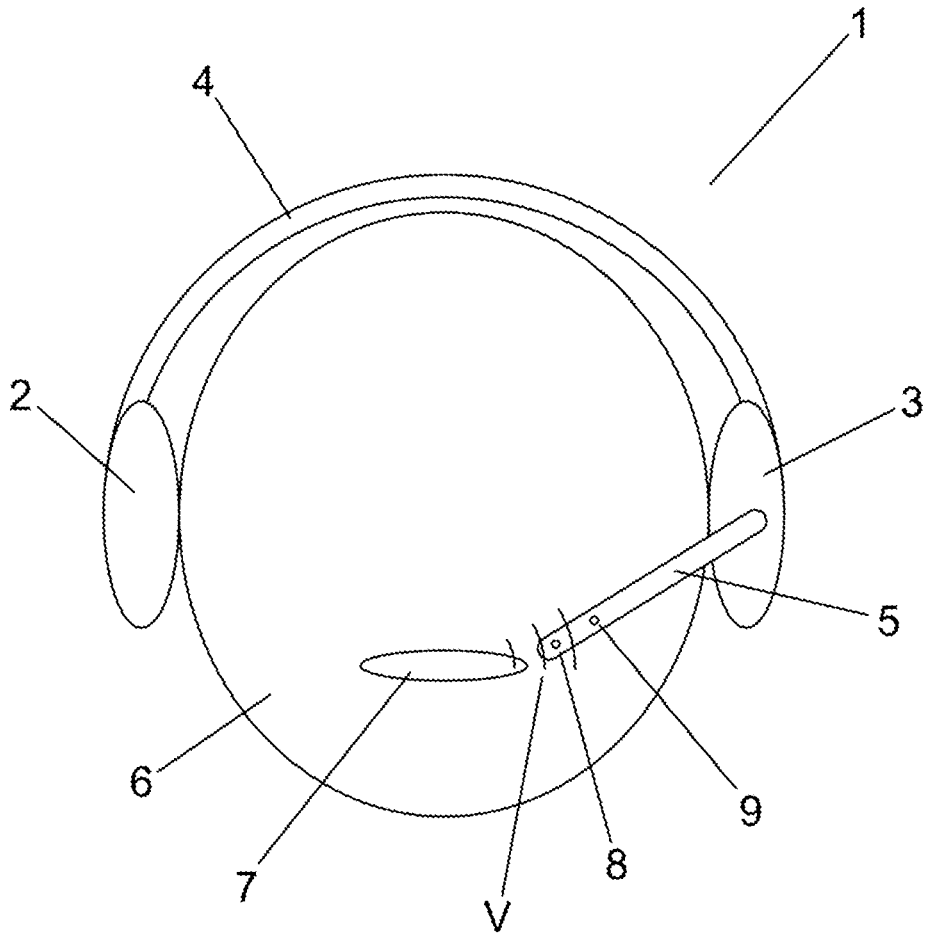
FIG. 1 shows an embodiment of a headset.

The headset 1 shown in FIG. 1 comprises a right-hand side earphone 2, a left-hand side earphone 3, a headband 4 mechanically interconnecting the earphones 2, 3 and a microphone arm 5 mounted at the left-hand side earphone 3. The headset 1 is designed to be worn in an intended wearing position on a user's head 6 with the earphones 2, 3 arranged at the user's respective ears and the microphone arm 5 extending from the left-hand side earphone 3 towards the user's mouth 7. The microphone arm 5 has a first sound inlet 8 and a second sound inlet 9 for receiving voice sound V from the user 6. In the following, the location of the user's mouth 7 relative to the sound inlets 8, 9 may be referred to as "speaker location". The headset 1 may preferably be designed such that when the headset is worn in the intended wearing position, a first one of the first and second sound inlets 8, 9 is closer to the user's mouth 7 than the respective other sound inlet 8, 9, however, the first and second sound inlets 8, 9 may alternatively be arranged such that they will have equal distances to the user's mouth 7. The headset 1 may preferably comprise a microphone apparatus as described in the following. Also other types of headsets may comprise such a microphone apparatus, e.g. a headset as shown but with only one earphone 3, a headset with other wearing components than a headband, such as e.g. a neck band, an ear hook or the like, or a headset without a microphone arm 5; in the latter case, the first and second sound inlets 8, 9 may be arranged e.g. at an earphone 2, 3 or on respective earphones 2, 3 of a headset.

Figure 2:
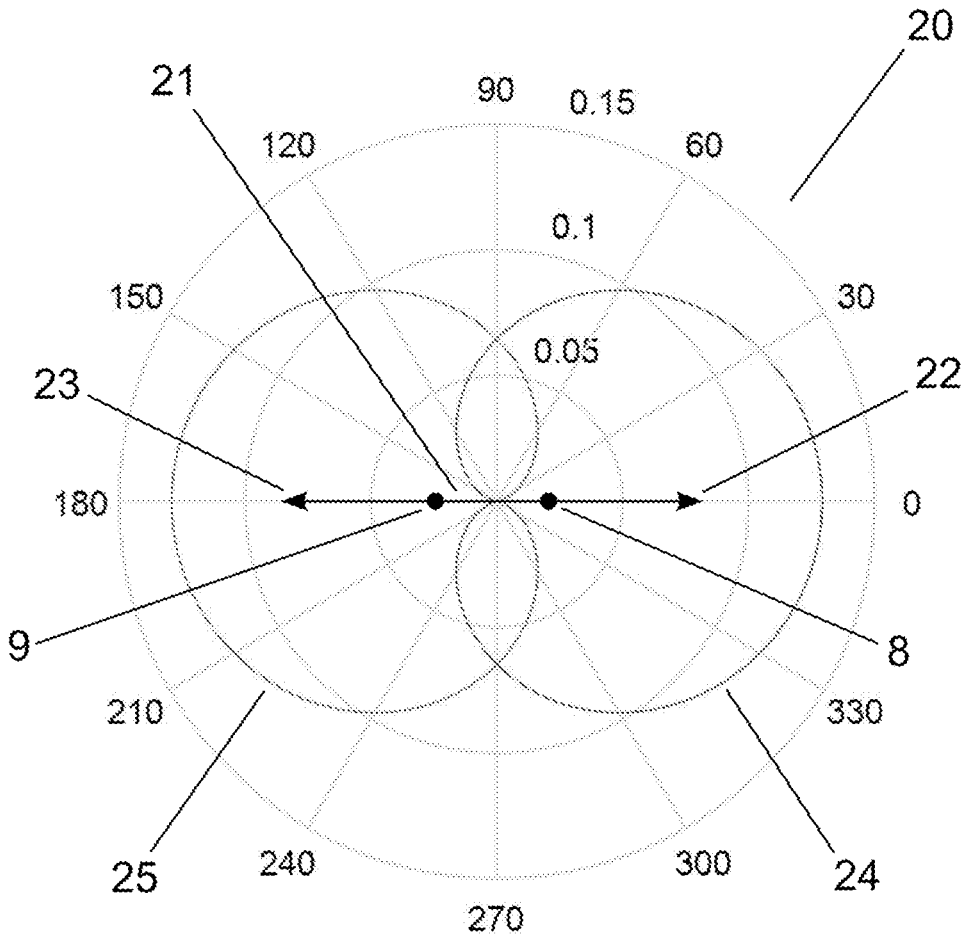
FIG. 2 shows example directional characteristics.

The polar diagram 20 shown in FIG. 2 defines relative spatial directions referred to in the present description. A straight line 21 extends through the first and the second sound inlets 8, 9. The direction indicated by arrow 22 along the straight line 21 in the direction from the second sound inlet 9 through the first sound inlet 8 is in the following referred to as "forward direction". The opposite direction indicated by arrow 23 is referred to as "rearward direction". An example cardioid directional characteristic 24 with a null in the rearward direction 23 is in the following referred to as "forward cardioid". An oppositely directed cardioid directional characteristic 25 with a null in the forward direction 22 is in the following referred to as "rearward cardioid".

Figure 3:
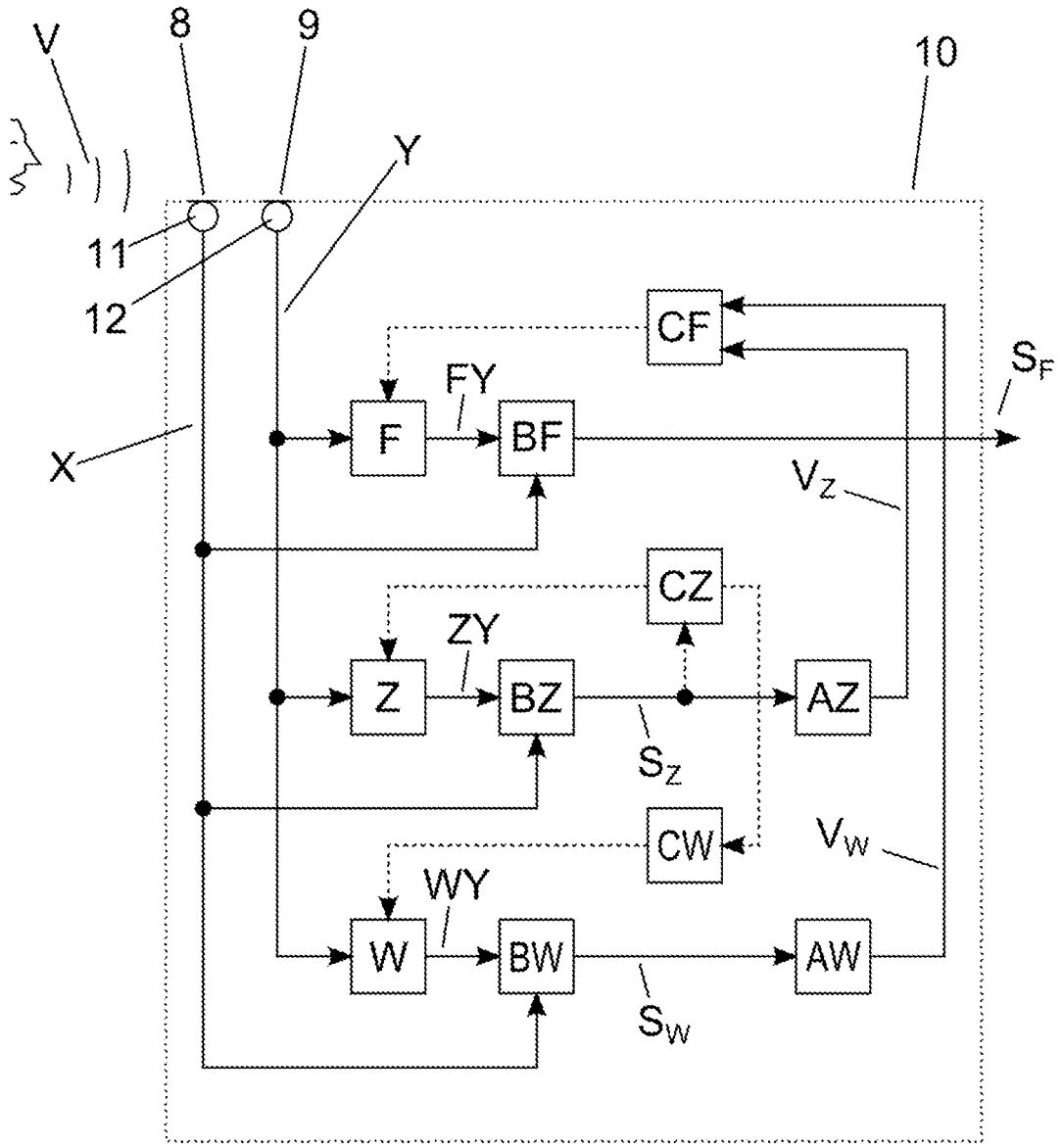
FIG. 3 shows an embodiment of a microphone apparatus.

The microphone apparatus 10 shown in FIG. 3 comprises a first microphone unit 11, a second microphone unit 12, a main filter F, a main mixer BF and a main filter controller CF. The microphone apparatus 10 provides an output audio signal $S_F$ in dependence on voice sound V received from a user 6 of the microphone apparatus. The microphone apparatus 10 may be comprised by an audio device, such as e.g. a headset 1, a speakerphone device, a stand-alone microphone device or the like. Correspondingly, the microphone apparatus 10 may comprise further functional components for audio processing, such as e.g. noise suppression, echo suppression, voice enhancement etc., and/or wired or wireless transmission of the output audio signal $S_F$. The output audio signal $S_F$ may be transmitted as a speech signal to a remote party, e.g. through a communication network, such as e.g. a telephony network or the Internet, or be used locally, e.g. by voice recording equipment or a public-address system.

The first microphone unit 11 provides a first input audio signal X in dependence on sound received at a first sound inlet 8, and the second microphone unit 12 provides a second input audio signal Y in dependence on sound received at a second sound inlet 9 spatially separated from the first sound inlet 8. Where the microphone apparatus 10 is comprised by a small device, like a stand-alone microphone, a microphone arm 5 or an earphone 2, 3, the spatial separation is normally chosen within the range 5-30 mm, but larger spacing may be used, e.g. where the microphone apparatus 10 comprises a first microphone unit 11 with a first sound inlet 8 arranged at a first earphone 2, 3 and a second microphone unit 12 with a second sound inlet 9 arranged at the respective other earphone 2, 3 of a headset 1.

The microphone apparatus 10 may preferably be designed to nudge or urge a user 6 to arrange the microphone apparatus 10 in a position with a first one of the first and second sound inlets 8, 9 closer to the user's mouth 7 than the respective other sound inlet 8, 9, or alternatively, with the first and second sound inlets 8, 9 at equal distances to the user's mouth 7. Where the microphone apparatus 10 is comprised by a headset 1 with a microphone arm 5 extending from an earphone 3, the first and second sound inlets 8, 9 may thus e.g. be located at the microphone arm 5 with one of the first and second sound inlets 8, 9 further away from the earphone 3 than the respective other sound inlet 8, 9.

The main filter F is a linear filter with a main transfer function $H_F$. The main filter F provides a main filtered audio signal FY in dependence on the second input audio signal Y, and the main mixer BF is a linear mixer that provides the output audio signal $S_F$ as a beamformed signal in dependence on the first input audio signal X and the main filtered audio signal FY. The main filter F and the main mixer BF thus cooperate to form a linear main beamformer F, BF as generally known in the art.

Depending on the intended use of the microphone apparatus 10, the first microphone unit 11 and the second microphone unit 12 may each comprise an omnidirectional microphone, in which case the main beamformer F, BF will cause the output audio signal $S_F$ to have a second-order directional characteristic, such as e.g. a forward cardioid 24, a rearward cardioid 25, a supercardioid, a hypercardioid, a bidirectional characteristic—or any of the other well-known second-order directional characteristics. A directional characteristic is normally used to suppress unwanted sound, i.e. noise, in order to enhance wanted sound, such as voice sound V from a user 6 of a device 1, 10. Note that the directional characteristic of a beamformed signal typically depends on the frequency of the signal.

In some embodiments, the main mixer BF may simply subtract the main filtered audio signal FY from the first input audio signal X to obtain the output audio signal $S_F$ with a desired directional characteristic, such as e.g. a forward cardioid 24. However, it is well known in the art that linear beamformers may be configured in a variety of ways and still provide output signals with identical directional characteristics. In further embodiments, the main mixer BF may thus be configured to apply other or further linear operations, such as e.g. scaling, inversion and/or addition, to obtain the output audio signal $S_F$. Note that the optimum main transfer function $H_F$ depends on such configuration of the main mixer BF because the main beamformer F, BF is adaptively controlled as described in the following. Generally, two linear beamformers with identical directional characteristics but with different configurations of their mixers will have filters with transfer functions, which are either equal or are scaled versions of each other, and which are thus congruent. In the present context, two transfer functions are considered congruent if and only if one of them can be obtained by a linear scaling of the respective other one, wherein linear scaling encompasses scaling by any factor, including the factor one and negative factors. Also, two filters are considered congruent if and only if their transfer functions are congruent.

The main filter controller CF controls the main transfer function $H_F$ of the main filter F to increase the relative amount of voice sound V in the output audio signal $S_F$. The main filter controller CF does this based on additional information derived from the first input audio signal X and the second input audio signal Y as described in the following. Note that this adaptation of the main transfer function $H_F$ also changes the directional characteristic of the output audio signal $S_F$.

In a first step, the microphone apparatus 10 estimates a linear suppression beamformer that may suppress user voice V—given current first and second input audio signals X, Y. For this estimation, the microphone apparatus 10 further comprises a suppression filter Z, a suppression mixer BZ and a suppression filter controller CZ. The suppression filter Z is a linear filter with a suppression transfer function $H_Z$. The suppression filter Z provides a suppression filtered signal ZY in dependence on the second input audio signal Y, and the suppression mixer BZ is a linear mixer that provides a suppression beamformer signal $S_Z$ as a beamformed signal in dependence on the first input audio signal X and the suppression filtered signal ZY. The suppression filter Z and the suppression mixer BZ thus cooperate to form the linear suppression beamformer Z, BZ as generally known in the art. The suppression filter controller CZ controls the suppression transfer function $H_Z$ of the suppression filter Z to minimize the suppression beamformer signal $S_Z$. The prior art knows many algorithms for achieving such minimization, and the suppression filter controller CZ may in principle apply any such algorithm. A preferred embodiment of the suppression filter controller CZ is described further below.

In an ideal case with the first and second audio input signals X, Y having equal delays relative to the sound at the respective sound inlets 8, 9, with steady broad-spectred voice sound V arriving exactly (and only) from the forward direction 22 and with steady and spatially omnidirectional noise, then the minimization by the suppression filter controller CZ would cause the suppression beamformer signal $S_Z$ to have a rearward cardioid directional characteristic 25 with a null in the forward direction 22, thus suppressing the voice sound V completely—also in the case that the first and the second microphone units 11, 12 have different sensitivities.

In a second step, the microphone apparatus 10 "flips" the suppression beamformer Z, BZ to provide a linear candidate beamformer for updating the main beamformer F, BF to further enhance user voice V in the output audio signal $S_F$. For this "flipping" operation and to enable a subsequent performance estimation, the microphone apparatus 10 further comprises a candidate filter W, a candidate mixer BW and a candidate filter controller CW. The candidate filter W is a linear filter with a candidate transfer function $H_W$. The candidate filter W provides a candidate filtered signal WY in dependence on the second input audio signal Y, and the candidate mixer BW is a linear mixer that provides a candidate beamformer signal $S_W$ as a beamformed signal in dependence on the first input audio signal X and the candidate filtered signal WY. The candidate filter W and the candidate mixer BW thus cooperate to form the linear candidate beamformer W, BW as generally known in the art. The candidate filter controller CW controls the candidate transfer function $H_W$ of the candidate filter W to be congruent with the complex conjugate of the suppression transfer function $H_Z$ of the suppression filter Z.

In the ideal case mentioned above, controlling the candidate transfer function $H_W$ to be congruent with the complex conjugate of the suppression transfer function $H_Z$ will cause the candidate beamformer W, BW to have the same directional characteristic as the suppression beamformer Z, BZ would have with swapped locations of the first and second sound inlets 8, 9, i.e. a forward cardioid 24, which effectively amounts to spatially flipping the rearward cardioid 25 with respect to the forward and rearward directions 22, 23. In the ideal case, the forward cardioid 24 is indeed the optimum directional characteristic for increasing or maximizing the relative amount of voice sound V in the output audio signal $S_F$. The requirement of complex conjugate congruence ensures that the flipping of the directional characteristic works independently of differences in the sensitivities of the first and the second microphone units 11, 12.

In a third step, the microphone apparatus 10 estimates the performance of the candidate beamformer W, BW, estimates whether it performs better than the current main beamformer F, BF, and in that case updates the main filter F to be congruent with the candidate filter W. The microphone apparatus 10 preferably estimates the performance by applying a predefined non-zero voice measure function A to each—or alternatively one—of the candidate beamformer signal $S_W$ and the suppression beamformer signal $S_Z$, wherein the voice measure function A is chosen to correlate with voice sound V in the respective beamformer signal $S_W$, $S_Z$. For the performance estimation, the microphone apparatus 10 thus further comprises a candidate voice detector AW and preferably further a residual voice detector AZ. The candidate voice detector AW uses the voice measure function A to determine a candidate voice activity measure $V_W$ of voice sound V in the candidate beamformer signal $S_W$, and the residual voice detector AZ preferably uses the same voice measure function A to determine a residual voice activity measure $V_Z$ of voice sound V in the suppression beamformer signal $S_Z$. The main filter controller CF controls the main transfer function $H_F$ to converge towards being congruent with the candidate transfer function $H_W$ in dependence on the candidate voice activity measure $V_W$ and preferably further on the residual voice activity measure $V_Z$. Depending on the configuration of the main mixer BF and the candidate mixer BW, the main filter controller CF may further apply linear scaling to ensure convergence of the directional characteristics of the main beamformer F, BF and the candidate beamformer W, BW.

Figure 4:
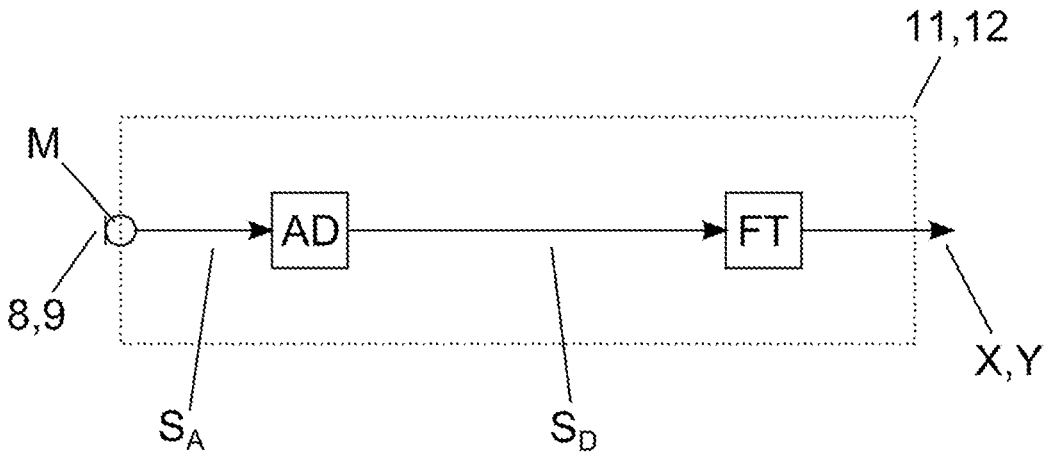
FIG. 4 shows an embodiment of a microphone unit.

Each of the first and second microphone units 11, 12 may preferably be configured as shown in FIG. 4. Each microphone unit 11, 12 may thus comprise an acoustoelectric input transducer M that provides an analog microphone signal $S_A$ in dependence on sound received at the respective sound inlet 8, 9, a digitizer AD that provides a digital microphone signal $S_D$ in dependence on the analog microphone signal $S_A$, and a spectral transformer FT that determines the frequency and phase content of temporally consecutive sections of the digital microphone signal $S_D$ to provide the respective input audio signal X, Y as a binned frequency spectrum signal. The spectral transformer FT may preferably operate as a Short-Time Fourier transformer and provide the respective input audio signal X, Y as a Short-Time Fourier transformation of the digital microphone signal $S_D$.

In addition to facilitating filter computation and signal processing in general, spectral transformation of the microphone signals $S_A$ provides an inherent signal delay to the input audio signals X, Y that allows the linear filters F, Z, W to implement negative delays and thereby enable free orientation of the microphone apparatus 10 with respect to the location of the user's mouth 7. However, where desired, one or more of the filter controllers CF, CZ, CW may be constrained to limit the range of directional characteristics. For instance, the suppression filter controller CZ may be constrained to ensure that any null in the directional characteristic of the suppression beamformer signal $S_Z$ falls within the half space defined by the forward direction 22. Many algorithms for implementing such constraints are known in the prior art.

The suppression filter controller CZ may preferably estimate the linear suppression beamformer Z, BZ based on accumulated power spectra derived from the first input audio signal X and the second input audio signal Y. This allows for applying well-known and effective algorithms, such as the finite impulse response (FIR) Wiener filter computation, to minimize the suppression beamformer signal $S_Z$. If the suppression mixer BZ is implemented as a subtractor, then the suppression beamformer signal $S_Z$ will be minimized when the suppression filtered signal ZY equals the first input audio signal X. FIR Wiener filter computation was designed for solving exactly this type of problems, i.e. for estimating a filter that for a given input signal provides a filtered signal that equals a given target signal. If the mixer BZ is implemented as a subtractor, then the first input audio signal X and the second input audio signal Y can be used respectively as target signal and input signal to a FIR Wiener filter computation that then estimates the wanted suppression filter Z.

Figure 5:
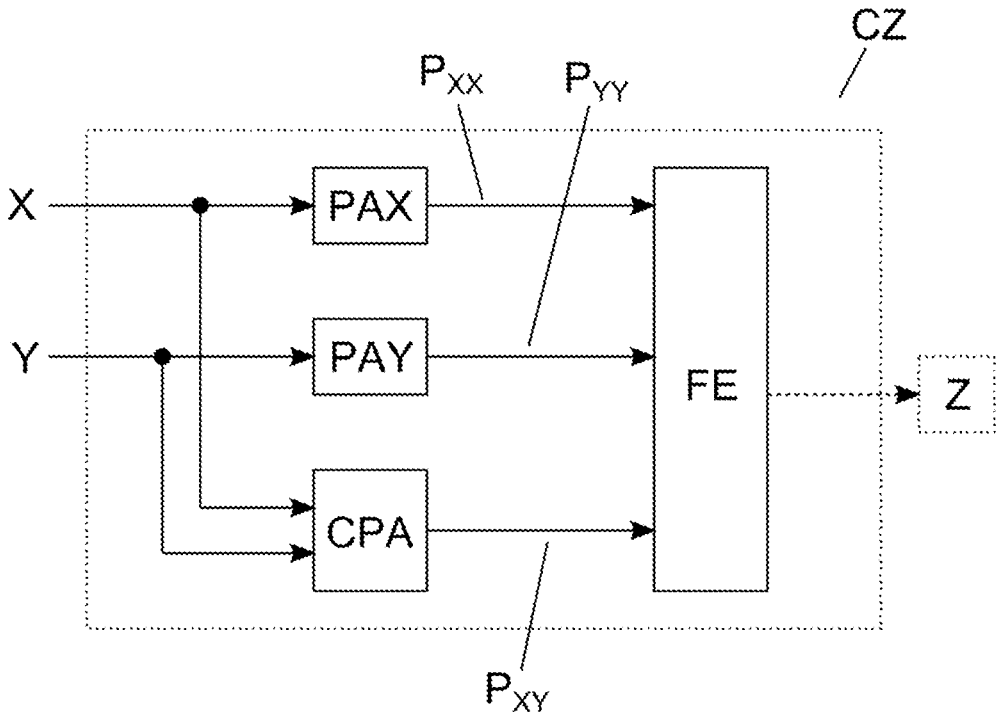
FIG. 5 shows an embodiment of a filter controller.

As shown in FIG. 5, the suppression filter controller CZ thus preferably comprises a first auto-power accumulator PAX, a second auto-power accumulator PAY, a cross power accumulator CPA and a filter estimator FE. The first auto-power accumulator PAX accumulates a first auto-power spectrum $P_{XX}$ based on the first input audio signal X, the second auto-power accumulator PAY accumulates a second auto-power spectrum $P_{YY}$ based on the second input audio signal Y, the cross power accumulator CPA accumulates a cross power spectrum $P_{XY}$ based on the first input audio signal X and the second input audio signal Y, and the filter estimator FE controls the suppression transfer function $H_Z$ of the suppression filter Z based on the first auto-power spectrum $P_{XX}$, the second auto-power spectrum $P_{YY}$ and the cross-power spectrum $P_{XY}$.

The filter estimator FE preferably controls the suppression transfer function $H_Z$ using a FIR Wiener filter computation based on the first auto-power spectrum, the second auto-power spectrum and the first cross-power spectrum. Note that there are different ways to perform the Wiener filter computation and that they may be based on different sets of power spectra, however, all such sets are based, either directly or indirectly, on the first input audio signal X and the second input audio signal Y.

Depending on the implementation of the suppression filter controller CZ and the suppression filter Z, the suppression filter controller CZ does not necessarily need to estimate the suppression transfer function $H_Z$ itself. For instance, if the suppression filter Z is a time-domain FIR filter, then the suppression filter controller CZ may instead estimate a set of filter coefficients that may cause the suppression filter Z to effectively apply the suppression transfer function $H_Z$.

It will usually be intended that the output audio signal $S_F$ provided by the main beamformer F, BF shall contain intelligible speech, and in this case the main beamformer F, BF preferably operates on input audio signals X, Y which are not—or only moderately—averaged or otherwise low-pass filtered. Conversely, since the main purpose of the suppression beamformer signal $S_Z$ and the candidate beamformer signal $S_W$ may be to allow adaptation of the main beamformer B, BF, the suppression beamformer Z, BZ and the candidate beamformer W, BW may preferably operate on averaged signals, e.g. in order to reduce computation load. Furthermore, a better adaptation to speech signal variations may be achieved by estimating the suppression filter Z and the candidate filter W based on averaged versions of the input audio signals X, Y.

Since each of the first auto-power spectrum $P_{XX}$, the second auto-power spectrum $P_{YY}$ and the cross-power spectrum $P_{XY}$ may in principle be considered an average of the respective spectral signal X, Y, Z, these power spectra may also be used for determining the candidate voice activity measure $V_W$ and/or the residual voice activity measure $V_Z$. Correspondingly, the suppression filter Z may preferably take the second auto-power spectrum $P_{YY}$ as input and thus provide the suppression filtered signal ZY as an inherently averaged signal, the suppression mixer BZ may take the first auto-power spectrum $P_{XX}$ and the inherently averaged suppression filtered signal ZY as inputs and thus provide the suppression beamformer signal $S_Z$ as an inherently averaged signal, and the residual voice detector AZ may take the inherently averaged suppression beamformer signal $S_Z$ as an input and thus provide the residual voice activity measure $V_Z$ as an inherently averaged signal.

Similarly, the candidate filter W may preferably take the second auto-power spectrum $P_{YY}$ as input and thus provide the candidate filtered signal WY as an inherently averaged signal, the candidate mixer BW may take the first auto-power spectrum $P_{XX}$ and the inherently averaged candidate filtered signal WY as inputs and thus provide the candidate beamformer signal $S_W$ as an inherently averaged signal, and the candidate voice detector AW may take the inherently averaged candidate beamformer signal $S_W$ as an input and thus provide the candidate voice activity measure $V_W$ as an inherently averaged signal.

The first auto-power accumulator PAX, the second auto-power accumulator PAY and the cross-power accumulator CPA preferably accumulate the respective power spectra over time periods of 50-500 ms, more preferably between 150 and 250 ms, to enable reliable and stable determination of the voice activity measures $V_W$, $V_Z$.

The candidate filter controller CW may preferably determine the candidate transfer function $H_W$ by computing the complex conjugation of the suppression transfer function $H_Z$. For a filter in the binned frequency domain, complex conjugation may be accomplished by complex conjugation of the filter coefficient for each frequency bin. In the case that the configuration of the candidate mixer BW differs from the configuration of the suppression mixer BZ, then the candidate filter controller CW may further apply a linear scaling to ensure correct functioning of the candidate beamformer W, BW.

In the case that the main filter F, the suppression filter Z and the candidate filter W are implemented as FIR time-domain filters, then the suppression transfer function $H_Z$ may not be explicitly available in the microphone apparatus 10, and then the candidate filter controller CW may compute the candidate filter W as a copy of the suppression filter Z, however with reversed order of filter coefficients and with reversed delay. Since negative delays cannot be implemented in the time domain, reversing the delay of the resulting candidate filter W may require that an adequate delay has been added to the signal used as X input to the candidate mixer BW. In any case, one or both of the first and second microphone units 11, 12 may comprise a delay unit (not shown) in addition to—or instead of—the spectral transformer FT in order to delay the respective input audio signal X, Y.

In the case that the first and second audio input signals X, Y have different delays relative to the sound at the respective sound inlets 8, 9, then the flipping of the directional characteristic will typically produce a directional characteristic of the candidate beamformer W, BW with a different type of shape than the directional characteristic of the suppression beamformer Z, BZ. Depending on the delay difference, the flipping may e.g. produce a forward hypercardioid characteristic from a rearward cardioid 25. This effect may be utilized to adapt the candidate beamformer W, BW to specific usage scenarios, e.g. specific spatial noise distributions and/or specific relative speaker locations 7. The main filter controller CF and/or the candidate filter controller CW may be adapted to control a delay provided by one or more of the spectral transformers FT and/or the delay units, e.g. in dependence on a device setting, on user input and/or on results of further signal processing.

The voice measure function A may be chosen as a function that simply correlates positively with an energy level or an amplitude of the respective signal $S_W$, $S_Z$ to which it is applied. The output of the voice measure function A may thus e.g. equal an averaged energy level or an averaged amplitude of the respective signal $S_W$, $S_Z$. In environments with high noise levels, however, more sophisticated voice measure functions A may be better suited, and a variety of such functions exists in the prior art, e.g. functions that also take frequency distribution into account.

Preferably, the main filter controller CF determines a candidate beamformer score E in dependence on the candidate voice activity measure $V_W$ and preferably further on the residual voice activity measure $V_Z$. The main filter controller CF may thus use the candidate beamformer score E as an indication of the performance of the candidate beamformer W, BW. The main filter controller CF may e.g. determine the candidate beamformer score E as a positive monotonic function of the candidate voice activity measure $V_W$ alone, as a difference between the candidate voice activity measure $V_W$ and the residual voice activity measure $V_Z$, or more preferably, as a ratio of the candidate voice activity measure $V_W$ to the residual voice activity measure $V_Z$. Using both the candidate voice activity measure $V_W$ and the residual voice activity measure $V_Z$ for determining the candidate beamformer score E may help to ensure that a candidate beamformer score E stays low when adverse conditions for adapting the main beamformer prevail, such as e.g. in situations with no speech and loud noise. The voice measure function A should be chosen to correlate positively with voice sound V in the respective beamformer signal $S_W$, $S_Z$, and the above suggested computations of the candidate beamformer score E should then also correlate positively with the performance of the candidate beamformer W, BW.

To increase the stability of the beamformer adaptation, the main filter controller CF preferably determines the candidate beamformer score E in dependence on averaged versions of the candidate voice activity measure $V_W$ and/or the residual voice activity measure $V_Z$. The main filter controller CF may e.g. determine the candidate beamformer score E as a positive monotonic function of a sum of N consecutive values of the candidate voice activity measure $V_W$, as a difference between a sum of N consecutive values of the candidate voice activity measure $V_W$ and a sum of N consecutive values of the residual voice activity measure $V_Z$, or more preferably, as a ratio of a sum of N consecutive values of the candidate voice activity measure $V_W$ to a sum of N consecutive values of the residual voice activity measure $V_Z$, where N is a predetermined positive integer number, e.g. a number between 2 and 100.

The main filter controller CF preferably controls the main transfer function $H_F$ in dependence on the candidate beamformer score E exceeding a beamformer-update threshold $E_B$, and preferably also increases the beamformer-update threshold $E_B$ in dependence on the candidate beamformer score E. For instance, when determining that the candidate beamformer score E exceeds the beamformer-update threshold $E_B$, the main filter controller CF may update the main filter F to equal, or be congruent with, the candidate filter W and at the same time set the beamformer-update threshold $E_B$ equal to equal the determined candidate beamformer score E. In order to accomplish a smooth transition, the main filter controller CF may instead control the main transfer function $H_F$ of the main filter F to slowly converge towards being equal to, or just congruent with, the candidate transfer function $H_W$ of the suppression filter Z. The main filter controller CF may e.g. control the main transfer function $H_F$ of the main filter F to equal a weighted sum of the candidate transfer function $H_W$ of the suppression filter Z and the current main transfer function $H_F$ of the main filter F. The main filter controller CF may preferably determine a reliability score R and determine the weights applied in the computation of the weighted sum based on the determined reliability score R, such that beamformer adaptation is faster when the reliability score R is high and vice versa. The main filter controller CF may preferably determine the reliability score R in dependence on detecting adverse conditions for the beamformer adaptation, such that the reliability score R reflects the suitability of the acoustic environment for the adaptation. Examples of adverse conditions include highly tonal sounds, i.e. a concentration of signal energy in only a few frequency bands, very high values of the determined candidate beamformer score E, wind noise and other conditions that indicate unusual acoustic environments.

The main filter controller CF preferably lowers the beamformer-update threshold $E_B$ in dependence on a trigger condition, such as e.g. power-on of the microphone apparatus 10, timer events, user input, absence of user voice V etc., in order to avoid that the main filter F remains in an adverse state, e.g. after a change of the speaker location 7. The main filter controller CF may e.g. reset the beamformer-update threshold $E_B$ to zero at power-on or when the user presses a reset-button, or e.g. regularly lower the beamformer-update threshold $E_B$ by a small amount, e.g. every five minutes. The main filter controller CF may preferably further reset the main filter F to a precomputed transfer function $H_F$ when resetting the beamformer-update threshold $E_B$ to zero, such that the microphone apparatus 10 learns the optimum directional characteristic anew each time. The precomputed transfer function $H_F$ may be predefined when designing or producing the microphone apparatus 10. Additionally, or alternatively, the precomputed transfer function $H_F$ may be computed from an average of transfer functions $H_F$ of the main filter F encountered during use of the microphone apparatus 10 and further be stored in a memory for reuse as precomputed transfer function $H_F$ after powering on the microphone apparatus 10, such that the microphone apparatus 10 normally starts up with a better starting point for learns the optimum directional characteristic.

The microphone apparatus 10 may further use the candidate beamformer score E as an indication of when the user 6 is speaking, and may provide a corresponding user-voice activity signal VAD for use by other signal processing, such as e.g. a squelch function or a subsequent noise reduction. Preferably, the main filter controller CF provides the user-voice activity signal VAD in dependence on the candidate beamformer score E exceeding a user-voice threshold $E_V$. Preferably, the main filter controller CF further provides a no-user-voice activity signal NVAD in dependence on the candidate beamformer score E not exceeding a no-user-voice threshold $E_N$, which is lower than the user-voice threshold $E_V$. Using the candidate beamformer score E for determination of a user-voice activity signal VAD and/or a no-user-voice activity signal NVAD may ensure improved stability of the signaling of user-voice activity, since the criterion used is in principle the same as the criterion for controlling the main beamformer.

In some embodiments, the candidate beamformer score E may be determined from an averaged signal, and in that case, a faster responding user-voice activity signal VAD and/or a faster responding no-user-voice activity signal NVAD may be obtained by letting the main filter controller CF instead provide these signals VAD, NVAD in dependence on a score $E_F$ determined by applying the voice measure function A to the output audio signal $S_F$.

Functional blocks of digital circuits may be implemented in hardware, firmware or software, or any combination hereof. Digital circuits may perform the functions of multiple functional blocks in parallel and/or in interleaved sequence, and functional blocks may be distributed in any suitable way among multiple hardware units, such as e.g. signal processors, microcontrollers and other integrated circuits.

The detailed description given herein and the specific examples indicating preferred embodiments of the invention are intended to enable a person skilled in the art to practice the invention and should thus be seen mainly as an illustration of the invention. The person skilled in the art will be able to readily contemplate further applications of the present invention as well as advantageous changes and modifications from this description without deviating from the scope of the invention. Any such changes or modifications mentioned herein are meant to be non-limiting for the scope of the invention.

The invention is not limited to the embodiments disclosed herein, and the invention may be embodied in other ways within the subject-matter defined in the following claims. As an example, features of the described embodiments may be combined arbitrarily, e.g. in order to adapt devices according to the invention to specific requirements.

Any reference numerals and names in the claims are intended to be non-limiting for the scope of the claims.

The invention claimed is:

1. A microphone apparatus configured to provide an output audio signal ($S_F$) in dependence on voice sound (V) received from a user of the microphone apparatus, the microphone apparatus comprising:

a first microphone unit configured to provide a first input audio signal (X) in dependence on sound received at a first sound inlet;

a second microphone unit configured to provide a second input audio signal (Y) in dependence on sound received at a second sound inlet spatially separated from the first sound inlet;

a linear main filter (F) with a main transfer function ($H_F$) configured to provide a main filtered audio signal (FY) in dependence on the second input audio signal (Y);

a linear main mixer (BF) configured to provide the output audio signal ($S_F$) as a beamformed signal in dependence on the first input audio signal (X) and the main filtered audio signal (FY); and a main filter controller (CF) configured to control the main transfer function ($H_F$) to increase the relative amount of voice sound (V) in the output audio signal ($S_F$), characterized in that the microphone apparatus further comprises:

a linear suppression filter (Z) with a suppression transfer function (Hz) configured to provide a suppression filtered signal (ZY) in dependence on the second input audio signal (Y);

a linear suppression mixer (BZ) configured to provide a suppression beamformer signal (Sz) as a beamformed signal in dependence on the first input audio signal (X) and the suppression filtered signal (ZY);

a suppression filter controller (CZ) configured to control the suppression transfer function (Hz) to minimize the suppression beamformer signal ($S_Z$);

a linear candidate filter (W) with a candidate transfer function (Hw) configured to provide a candidate filtered signal (WY) in dependence on the second input audio signal (Y);

a linear candidate mixer (BW) configured to provide a candidate beamformer signal ($S_W$) as a beamformed signal in dependence on the first input audio signal (X) and the candidate filtered signal (WY);

a candidate filter controller (CW) configured to control the candidate transfer function (Hw) to be congruent with the complex conjugate of the suppression transfer function ($H_Z$); and a candidate voice detector (AW) configured to use a voice measure function (A) to determine a candidate voice activity measure (Vw) of voice sound (V) in the candidate beamformer signal (Sw), and in that the main filter controller (CF) further is configured to control the main transfer function ($H_F$) to converge towards being congruent with the candidate transfer function (Hw) in dependence on the candidate voice activity measure (Vw).

2. A microphone apparatus according to claim 1, wherein the suppression filter controller (CZ) further is configured to:

accumulate a first auto-power spectrum (Pxx) based on the first input audio signal (X);

accumulate a second auto-power spectrum (Pyy) based on the second input audio signal (Y);

accumulate a first cross-power spectrum (Pxy) based on the first input audio signal (X) and the second input audio signal (Y); and control the suppression transfer function (Hz) based on the first auto-power spectrum (Pxx), the second auto-power spectrum (Pyy) and the first cross-power spectrum (Pxy).

3. A microphone apparatus according to claim 2, wherein the suppression filter controller (CZ) further is configured to control the suppression transfer function (Hz) using a finite impulse response Wiener filter computation based on the first auto-power spectrum (Pxx), the second auto-power spectrum (Pyy) and the first cross-power spectrum (Pxy).

4. A microphone apparatus according to claim 1, and further comprising a residual voice detector (AZ) configured to use the voice measure function (A) to determine a residual voice activity measure (Vz) of voice sound (V) in the suppression beamformer signal (Sz), and wherein the main filter controller (CF) further is configured to control the main transfer function ($H_F$) to converge towards being congruent with the candidate transfer function (Hw) in dependence on the candidate voice activity measure (Vw) and the residual voice activity measure (Vz).

5. A microphone apparatus according to claim 4, wherein the main filter controller (CF) further is configured to:

determine a candidate beamformer score (E) in dependence on the candidate voice activity measure (Vw) and the residual voice activity measure ($V_Z$);

control the main transfer function ($H_F$) in further dependence on the candidate beamformer score (E) exceeding a first threshold ($E_B$); and increase the first threshold ($E_B$) in dependence on the candidate beamformer score (E).

6. A microphone apparatus according to claim 5, wherein the main filter controller (CF) further is configured to provide a user-voice activity signal (VAD) in dependence on a beamformer score (E, $E_F$) exceeding a second threshold (Ev).

7. A microphone apparatus according to claim 6, wherein the main filter controller (CF) further is configured to provide a no-user-voice activity signal (NVAD) in dependence on a beamformer score (E, $E_F$) not exceeding a third threshold ($E_N$), wherein the third threshold ($E_N$) is lower than the second threshold (Ev).

8. A microphone apparatus according to claim 1, wherein the voice measure function (A) correlates positively with an energy level or an amplitude of a signal ($S_W$, Sz) to which it is applied.

9. A microphone apparatus according to claim 1, wherein the first microphone unit comprises a first delay unit configured to delay the first input audio signal (X) and/or the second microphone unit comprises a second delay unit adapted to delay the second input audio signal (Y).

10. A headset (1) comprising a microphone apparatus (10) according to claim 1.

* * * * *